US010308394B1

(12) United States Patent
Robl et al.

(10) Patent No.: US 10,308,394 B1
(45) Date of Patent: Jun. 4, 2019

(54) CONTAINER LID STACKABLE WITH ONE OR TWO SMALLER CONTAINERS

(71) Applicants: Michael T. Robl, Madison, WI (US); Donald E. McCumber, Madison, WI (US)

(72) Inventors: Michael T. Robl, Madison, WI (US); Donald E. McCumber, Madison, WI (US)

(73) Assignee: PLACON CORPORATION, Madison, WI (US)

( * ) Notice: Subject to any disclaimer, the term of this patent is extended or adjusted under 35 U.S.C. 154(b) by 55 days.

(21) Appl. No.: 15/585,152

(22) Filed: May 2, 2017

(51) Int. Cl.

| | |
|---|---|
| ***B65D 21/02*** | (2006.01) |
| ***B65D 21/06*** | (2006.01) |
| *B65D 51/16* | (2006.01) |
| *B65D 43/02* | (2006.01) |

(52) U.S. Cl.
CPC ..... *B65D 21/0209* (2013.01); *B65D 21/064* (2013.01); *B65D 21/02* (2013.01); *B65D 43/0206* (2013.01); *B65D 51/1627* (2013.01); *B65D 2543/00027* (2013.01); *B65D 2543/00435* (2013.01)

(58) Field of Classification Search
CPC ..... B65D 21/02; B65D 21/0209; B65D 21/0217; B65D 21/0219; B65D 21/0222; B65D 21/0223
See application file for complete search history.

(56) References Cited

U.S. PATENT DOCUMENTS

| | | | | |
|---|---|---|---|---|
| 2,695,115 | A | 4/1953 | Roop | |
| 3,117,692 | A | 1/1964 | Carpenter et al. | |
| 4,286,713 | A | 9/1981 | Marchais | |
| 4,832,200 | A | 5/1989 | Deaton et al. | |
| 5,419,451 | A | 5/1995 | Bitel, Jr. | |
| D360,336 | S | 7/1995 | Bitel, Jr. | |
| 6,371,364 | B1 | 4/2002 | Maillot et al. | |
| 7,017,775 | B2 | 3/2006 | Lettle et al. | |
| 7,032,773 | B2 | 4/2006 | Dees et al. | |
| 7,798,353 | B2 | 9/2010 | Blythe et al. | |
| D677,150 | S | 3/2013 | Barbier | |
| 8,523,006 | B2 | 9/2013 | Barbier | |
| 8,851,287 | B2 | 10/2014 | Becklin | |
| 9,108,766 | B2 * | 8/2015 | Gosen | B65D 21/0223 |
| 2008/0116098 | A1 | 5/2008 | Marooflan et al. | |
| 2012/0006837 | A1 | 1/2012 | Becklin | |
| 2012/0168449 | A1 | 7/2012 | Barbier | |

* cited by examiner

*Primary Examiner* — Andrew T Kirsch
*Assistant Examiner* — Don M Anderson
(74) *Attorney, Agent, or Firm* — Stiennon & Stiennon

(57) ABSTRACT

A system of containers forming a group of two and three containers, where one and two smaller containers can be positioned on a lid of a larger container so as to prevent sliding motion of the smaller containers. Each of the smaller containers having a bottom wall of substantially the same dimensions with a portion of the bottom wall forming an upwardly extending indentation. The small containers are formed with upwardly opening walls and have lids releasably engageable with the bottom. The larger container lid having a flat upper surface which is sized to hold at least two of the smaller containers, and having structures to position one, and to position two smaller containers against sliding movement on said flat upper surface such that whether one container or two containers, the smaller containers are balanced about a central axis of the larger container and lid.

7 Claims, 4 Drawing Sheets

CONTAINER LID STACKABLE WITH ONE OR TWO SMALLER CONTAINERS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to stackable containers in general and containers for take out food in particular.

In recent times food on the go has become part of the solution to the hectic pace of life in the modern age. For some fast food restaurants more meals are ordered from the drive-through window than dine in. Grocery stores continue to expand their offerings of ready to eat lunch and dinner entrées. With hundreds of different entrées to choose from in your local grocery store, solutions for packaging takeout items are ever more in demand. Often with so many entrées available frequently sold by weight, the consumer wishes to combine several entrées so as to have a more complete meal or sometimes to purchase smaller amounts of different items to be consumed at different times. The problem arises that each entrée when packaged in a separate take-out container becomes collectively difficult to handle, with the possibility of items being dropped and thus scrambled and made less palatable. What is needed is a system of two or more food containers which can be stacked to form a balanced and easily handled grouping of items which will be eaten or served for the take-out meal.

SUMMARY OF THE INVENTION

The container system of the present invention comprises a single larger container consisting of an upwardly opening container and the resealable lid which holds a main or first entrée, and one or two additional smaller containers to handle separate entrées which are so linked as to make them balanced so as to easily transport groupings of containers. The container comprises two or three thermal formed container bases and corresponding lids. The resealable lids rise some distance above the open container increasing the volume of the container and having a flat region rendering of the containers that are geometrically simple like stackable blocks. One larger container for the main entrée has an upper lid surface on which at least two raised structures are formed. The raised structures are each arranged to extend into a depression in the bottom of two smaller containers to position and hold the smaller containers on the upper surface of the larger container lid so that the larger container and the two smaller containers can be moved as a unit without danger that the smaller units will slide off the larger unit cover. Two raised structures are spaced apart and form mirror images, one with the other, and are further arranged to hold a single container centered over the larger container. The two raised structures have the appearance of brackets which engage the ends of the container. The raised structures can be seen as a single raised structure in which a depression is formed to hold one container against movement on the larger container's lid. Redundant structures unnecessary for preventing movement of the single smaller container are then removed leaving the two brackets each of which can hold one of two smaller containers of the same base dimensions by extending into the depression of the two smaller containers.

The container system thus formed comprises one size of large containers and two or more sizes of small containers each of which has the same base area but a different interior volume defined by the height of the smaller containers. Design applications 29/589,756, 29/589,764 and 29/589,771 all having a filing date of Jan. 4, 2017 are incorporated herein by reference.

It is an object of the present invention to provide a container system with relatively few containers such as three or four, which collectively provide the packaging for a wide variety of entrée selections and then allow the selections to be grouped in such a way that they form a balanced unit which can be conveniently and reliably handled.

Further objects, features and advantages of the invention will be apparent from the following detailed description when taken in conjunction with the accompanying drawings.

DESCRIPTION OF THE PREFERRED EMBODIMENTS

Figure 1:
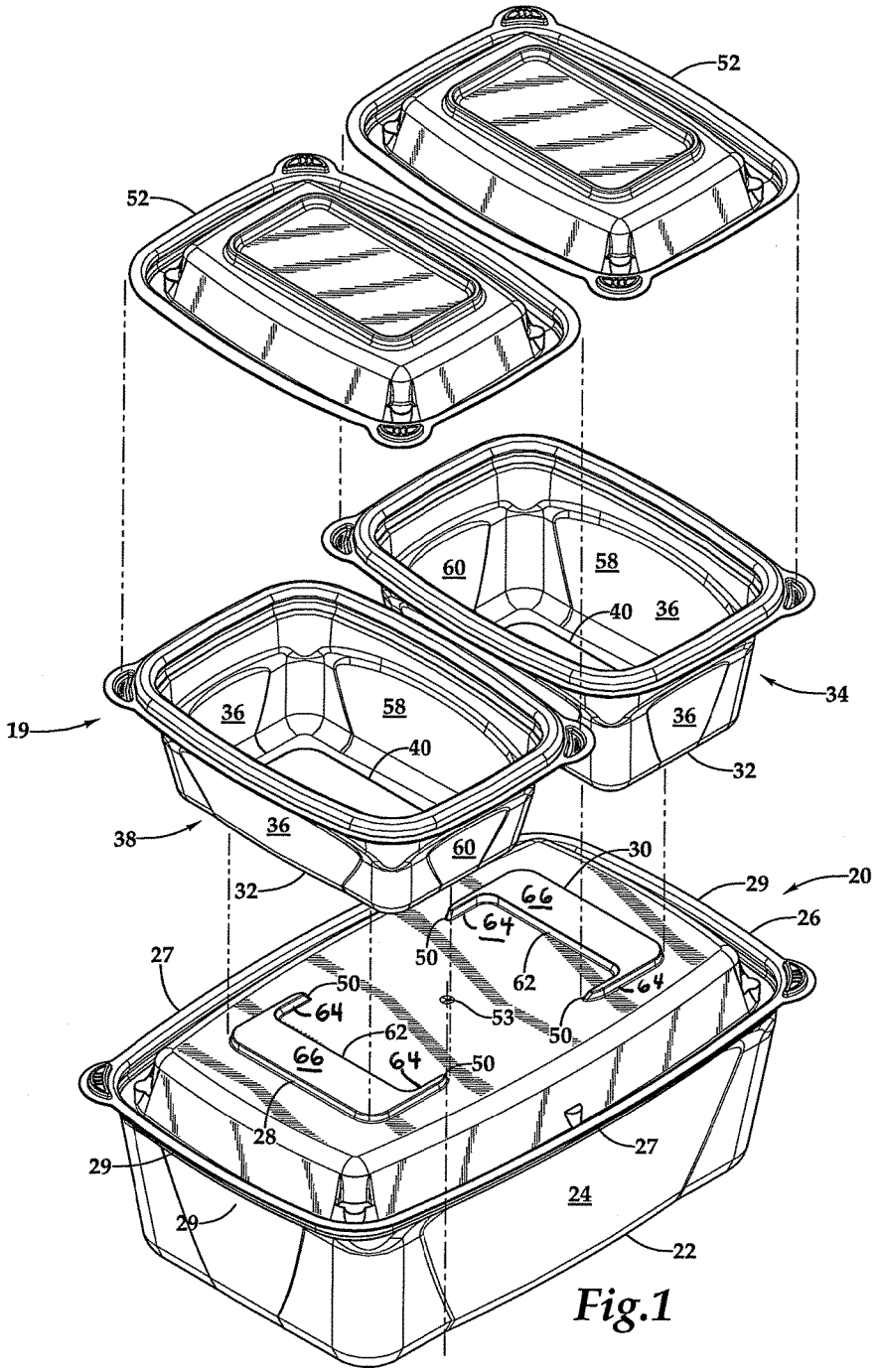
FIG. 1 is an exploded isometric view of the container system of this invention.
Figure 2:
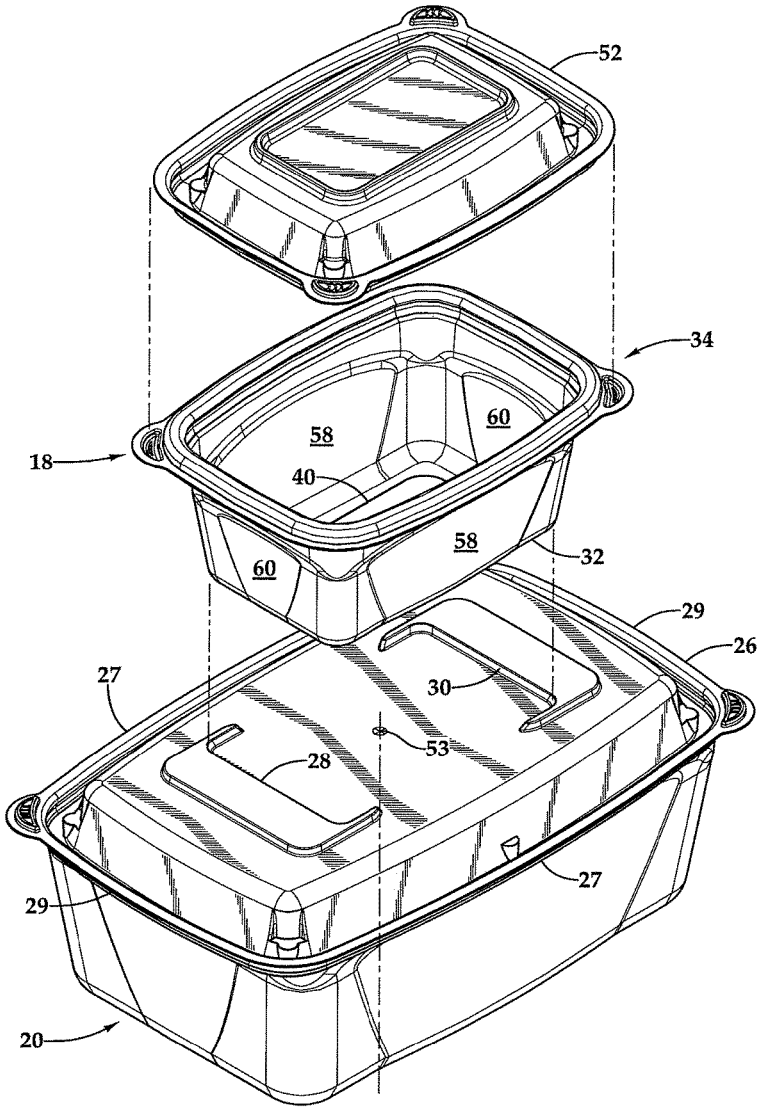
FIG. 2 is an exploded isometric view of a single secondary container positioned over a primary container.
Figure 3:
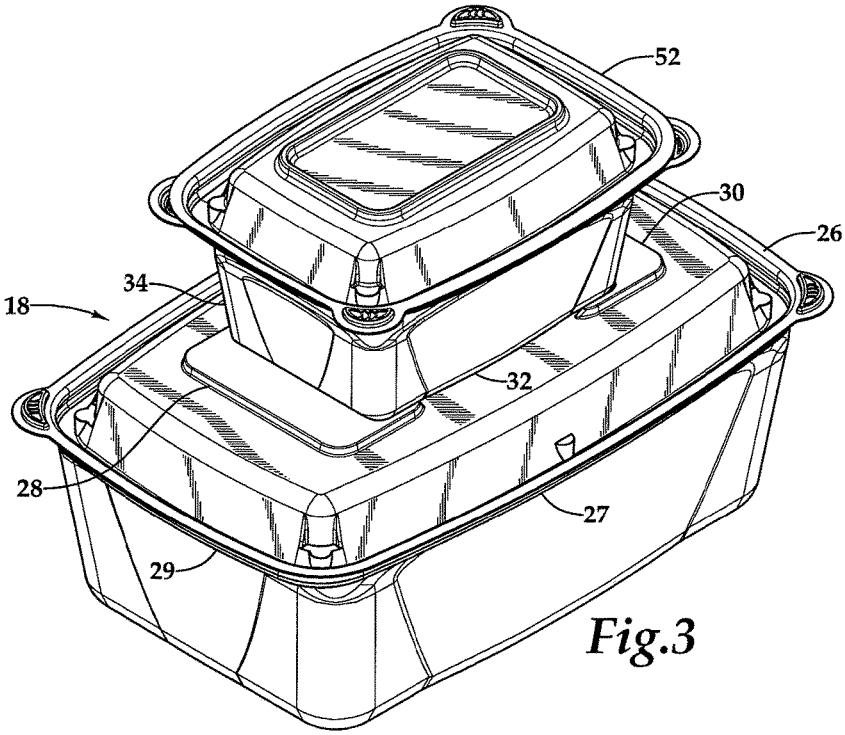
FIG. 3 is an isometric view of two secondary containers positioned on the lid of a primary container.
Figure 4:
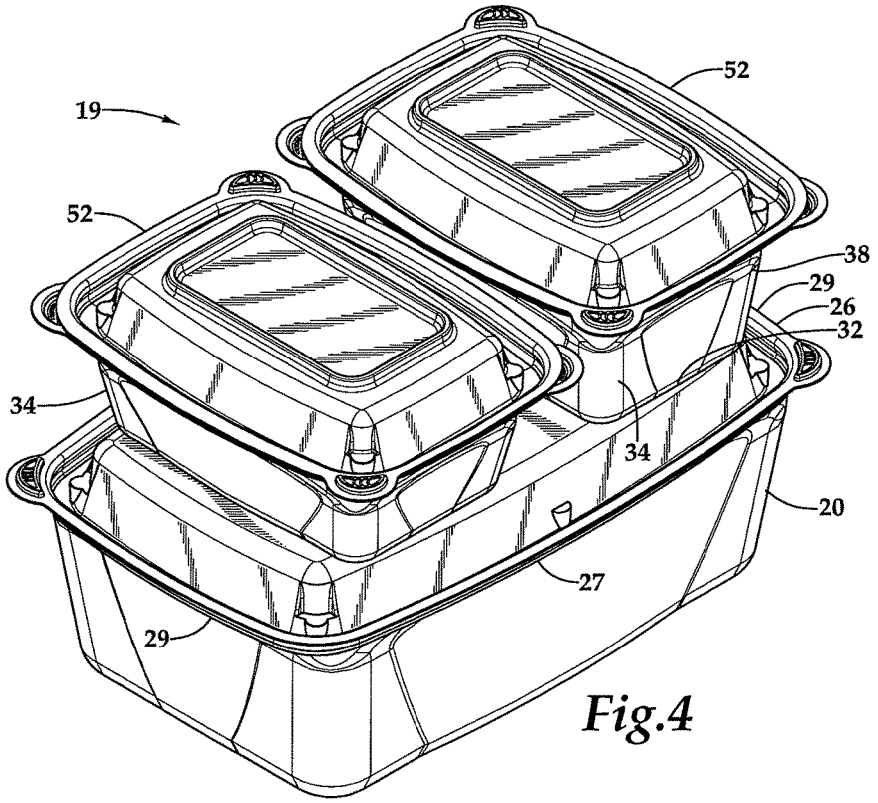
FIG. 4 is an isometric view of a single secondary container positioned on the lid of a primary container.

Referring more particularly to FIGS. 1-4 wherein like numbers refer to similar parts of a system of two and three containers 18, 19 is shown in FIGS. 3 and 4, each system comprises a primary container 20 and one or two secondary containers 34 and 38. The primary container 20 best shown in FIGS. 1 and 2 is composed of a base wall 22 and the sidewalls 24 and a lid 26. The lid 26 has two long sides 27 and two short sides 29 which form an approximately rectangular shape. The primary container 20 lid 26 has a long direction extending between the two short sides 29 and two raised positioning structures 28 and 30 which are mirror images of each other, and are spaced from each other in the long direction. The two positioning structures 28 and 30 cooperate to hold the base or bottom wall 32 of a secondary container 34 as shown in FIGS. 2 and 3. The positioning structures 28 and 30 together extend upwardly from the lid 26 in a direction away from the base wall 22 of the primary container 20. The raised positioning structures 28 and 30 together at least partially surround all four side walls 36 which extend upwardly away from the bottom wall 32 of the secondary container 34. The positioning structures 28 and 30, while not positively locking the secondary container 34 to the lid 26 of the primary container 20, function to prevent the secondary container 34 from sliding off the lid 28 of the primary structure because it is constrained on four sides. When the primary and secondary containers 20, 34 are used together to contain food items, normally ready to eat or take out food items, they facilitate moving the system of containers 18 while stacked such that they can be placed in a bag or moved one-handedly.

Figure 5:
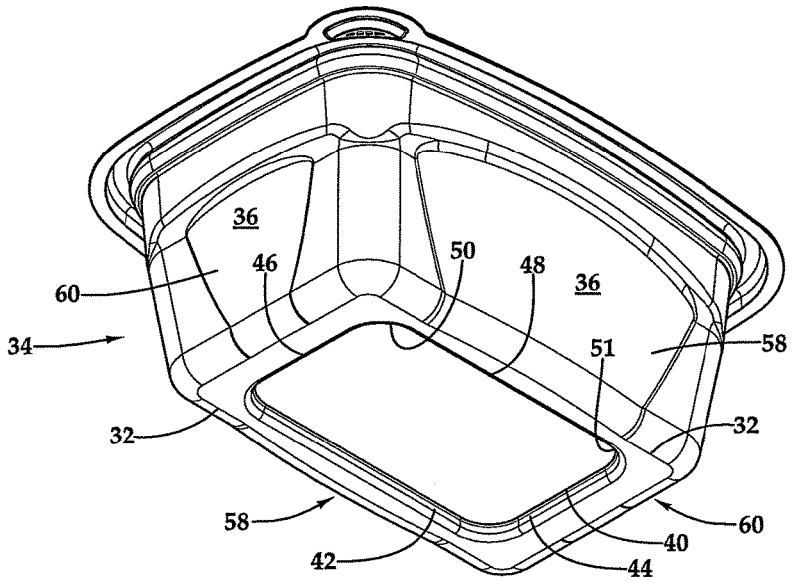
FIG. 5 is an isometric bottom view of a single secondary container.
Figure 6:
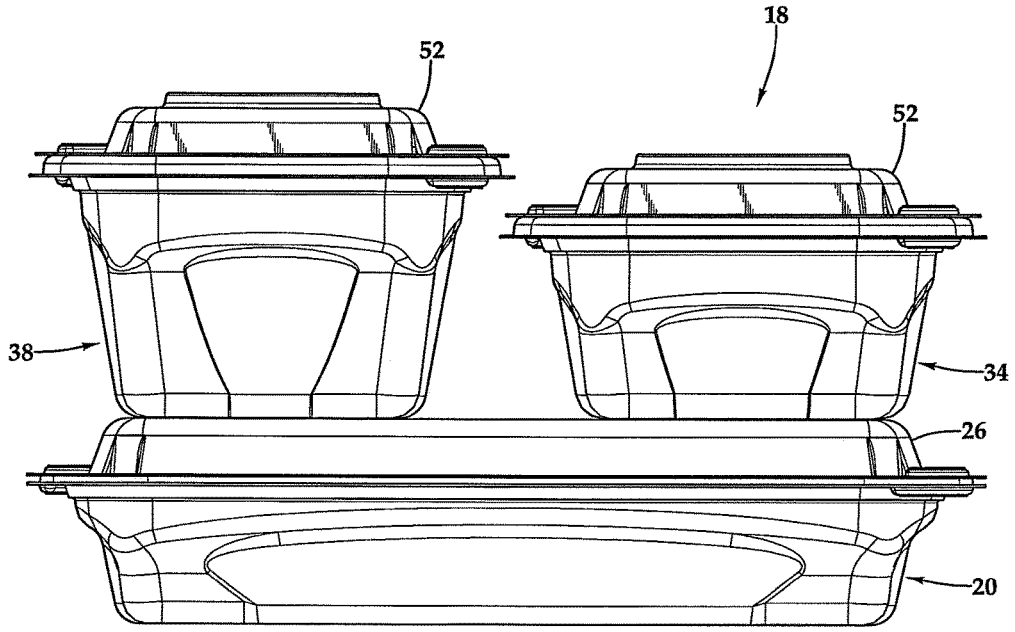
FIG. 6 is an isometric view of two secondary containers positioned on the lid of a primary container.

Many more complex entrées have more than one side dish or sauce such that two secondary containers 34 and 38 are advantageously employed in the container system 18 as shown in FIGS. 1 and 4. This can be accommodated using the same positioning structures 28 and 30. Each positioning structure 28, 30 fits into a rectangular indentation 40, best shown in FIG. 5, on the bottom wall 32 of each secondary container 34, 38. Each primary container lid positioning structure completely engages the rectangular indentation 40 of a secondary container on three indented side walls 42, 44, 46 and effectively engages the fourth indented side wall 48. This effective engagement on the fourth side 48, utilizes the principle that two points define a line, where the inner tips 50 of the positioning structures form the two points which engage the fourth wall 48 of the secondary indentation 40 at contact points 51 shown in FIG. 5. Finally, the secondary containers 34 and 38 are of different heights so that their lids 52 do not interfere with the positioning of the secondary containers as shown in FIG. 6.

It is important that the mass of one or both of the secondary containers is arranged such that the containers as a system of two or three containers 18, 19 as shown in FIGS. 3 and 4, are such that the combined container systems 18, 19 do not become awkward by being unbalanced, e.g., the secondary containers 34, 38 whether one or two are arranged symmetrically about a vertical axis 53 through the geometric centroid of the primary container 20.

To accomplish the function of holding one container or two containers against sliding motion on the lid 26 of the primary container 20 while centering the masses of the secondary containers 34, 38 with respect to the primary container requires meeting certain geometric constraints.

The first geometric constraint is that the lid 26 of the primary container must be sufficiently large as to support two of the secondary containers 34, 38 on the lid 26. A second constraint is that the depth of the indentation 40 formed by side walls 42, 44, 46 and 48 on the bottom wall 32 of each secondary container 34, 38, must be indented to a greater depth than the height of the raised structures 28 and 30 such that each of the raised structures can fit within the indentation 40 of either of the secondary containers. A third constraint is that the secondary container 34, 38 has two longer exterior walls 58 and two shorter exterior walls 60, wherein the shorter walls have a length that is less than the longer walls 42, 48 of the indentation 40. The result of this third constraint is that bracket-shaped indentations 62 can be formed in the raised structure 28, 30 to hold a single secondary container 34, 38 without destroying the functionality of the raised structures to engage and hold against movement of each of the two secondary containers. As shown in FIG. 1, each raised structure thus has a body 64 with two protruding limbs 66 which together define each bracket-shaped indentation 60. The limbs 66 of one raised structure extend towards the limbs of the opposite raised structure 28. Fourthly, the spacing of the raised structure 28, 30 must be such that the bracket-shaped indentations 62 in the raised structures each engage three sides of a single secondary container 34, 38 to hold them in position on the lid 26. Finally, width to length ratios of the secondary containers 34, 38 are such that the spacing of the raised structure 28, 30 defined by the length of the secondary container 34 or 38 is sufficient such that when the raised structures engage two secondary containers the secondary containers fit without interference with each other.

It should be understood that the raised structures 28, 30 could have various shapes and each be made of more than one raised portion, so long as such raised portions have structures which function the same or similarly to the above described structures. For example, any part of the raised structures which is not arranged to bear against the exterior of one of the smaller containers, or a wall 42, 44, 46 and 48 of the indentation 40 is unnecessary and may be eliminated. Basically at least two points spaced apart by at least a 0.25 inch or 0.5 inch, more preferably at least 1 inch or a linear structure of similar dimensions must be arranged to bear against the exterior walls of a single container or the interior walls of the indentations of two containers so as to substantially prevent the smaller containers sliding movement on the lid of the larger container.

It is understood that the invention is not limited to the particular construction and arrangement of parts herein illustrated and described, but embraces all such modified forms thereof as come within the scope of the following claims.

We claim:

1. A system of containers which form a group of two and a group of three containers, where one of the containers or two of the containers can be positioned on a lid of the other container so as to prevent sliding motion along the lid of the positioned container or containers, the system comprising:

a primary container having a lid;

two secondary containers, each of which has a bottom wall and side walls which extend upwardly from the bottom wall, the side walls comprising two opposed exterior long side walls, which are both longer than two opposed exterior short side walls, wherein portions of each secondary container bottom wall define an indentation which extends inwardly of the container, each indentation having two opposed short side walls and two opposed long side walls, the bottom wall indentation long side walls being longer than the bottom wall indentation short side walls, and wherein the exterior short side wall is shorter than the indentation long side wall;

portions of the primary container lid forming at least a first raised structure and a second raised structure which extend away from the primary container, the first raised structure being spaced a maximum spacing on the lid from the second raised structure;

wherein in a first group of containers, the two secondary containers are disposed on the primary container lid, and the first raised structure engages against both indentation short side walls of one of the secondary containers, and both indentation long side walls of said one secondary container, said one secondary container being thereby restricted from slipping on the primary container lid;

wherein in the first group of containers the second raised structure engages against both indentation short side walls of another one of the secondary containers, and both indentation long side walls of said another one of the secondary containers, said another one of the secondary containers being thereby restricted from slipping on the primary container lid;

wherein the first raised structure and the second raised structure maximum spacing is less than the length of the secondary containers exterior long side walls at the base, and wherein in a second group of containers the first raised structure and the second raised structure cooperate to restrain only one of the secondary containers from slipping on the primary container lid, by engaging portions of the first raised structure with one of said secondary container's short side walls and two of its long side walls, and the second raised structure with the other of said secondary container's short side walls and said two of the secondary container's long side walls.

2. The system of containers of claim 1 wherein the primary container lid first raised structure and second raised structure have multiple points of engagement to restrain the secondary containers, and in the second group of containers, the first raised structure and the second raised structure together have at least two points which engage each of the exterior walls of the only one of the secondary containers, the said two points spaced apart by at least 0.25 inches along the respective engaged wall, the said points arranged to bear against each exterior wall of the only one of the secondary containers, and wherein alternatively in the first group of containers the first raised structure and the second raised structure together have at least two points which are disposed to bear against each of the secondary container interior walls of the bottom wall indentations to constrain the two secondary containers not to slide on the primary container lid.

3. The system of containers of claim 2 wherein the at least two points disposed to engage against each exterior wall of the only one secondary container are spaced apart at least 0.5 inches.

4. The system of containers of claim 3 wherein the at least two points disposed to engage against the interior walls of the indentations of the two secondary containers are spaced apart at least 0.5 inches.

5. The system of containers of claim 4 wherein the at least two points disposed to engage against each exterior wall of the only one secondary container are spaced apart at least 1 inch.

6. The system of containers of claim 2 wherein the at least two points disposed to engage against each exterior wall of the only one secondary container are each part of a line of one of the first raised structure and the second raised structure.

7. A container lid for supporting one or two secondary containers thereon, each secondary container having a bottom wall and side walls which extend upwardly from the bottom wall, the side walls comprising two opposed exterior long side walls, which are both longer than two opposed exterior short side walls, wherein portions of each secondary container bottom wall define an indentation which extends inwardly of the container, each indentation having two opposed short side walls and two opposed long side walls, the bottom wall indentation long side walls being longer than the bottom wall indentation short side walls, and wherein the exterior short wall is shorter than the indentation long wall, the container lid comprising:

lid wing upper surface portions;

portions of the lid upper surface portions which define two mirror image protrusions extending upwardly of the upper surface and, each mirror image protrusion defining a raised structure that has a body with two protruding limbs, a bracket shape being defined between the limbs and along the body, and wherein the limbs of one raised structure extend towards the limbs of the opposite raised structure;

wherein each protrusion is dimensioned to fit within said secondary container bottom wall indentation, and wherein the bracket shapes defined on the two mirror image protrusion raised structures are positioned to receive said secondary contrary exterior walls between the two mirror image protrusion raised structures.

* * * * *